US008677570B2

(12) United States Patent
Swain et al.

(10) Patent No.: US 8,677,570 B2
(45) Date of Patent: Mar. 25, 2014

(54) SLIDER FOR WATER-RESISTANT ZIPPERS

(75) Inventors: Henry Swain, Whitehouse Station, NJ (US); Lynnette Colby, Arlington Heights, IL (US); Lawrence Share, Skokie, IL (US); Valoris L. Forsyth, Lewisville, TX (US)

(73) Assignee: Illinois Tool Works Inc., Glenview, IL (US)

( * ) Notice: Subject to any disclaimer, the term of this patent is extended or adjusted under 35 U.S.C. 154(b) by 527 days.

(21) Appl. No.: 12/967,179

(22) Filed: Dec. 14, 2010

(65) Prior Publication Data

US 2011/0308050 A1 Dec. 22, 2011

Related U.S. Application Data

(63) Continuation-in-part of application No. 11/820,544, filed on Jun. 20, 2007, now Pat. No. 7,849,565.

(51) Int. Cl.
*A44B 19/26* (2006.01)
*B65D 33/25* (2006.01)

(52) U.S. Cl.
USPC ..... 24/30.5 R; 24/30.5 L; 24/433; 24/585.12; 383/64

(58) Field of Classification Search
USPC ..... 24/30.5 R, 30.5 I, 585.12, 433; 383/64
See application file for complete search history.

(56) References Cited

U.S. PATENT DOCUMENTS

| | | | | |
|---|---|---|---|---|
| 3,220,076 | A | 11/1965 | Ausnit et al. | |
| 5,007,142 | A * | 4/1991 | Herrington | 24/585.12 |
| 5,007,143 | A * | 4/1991 | Herrington | 24/585.12 |
| 5,010,627 | A * | 4/1991 | Herrington et al. | 24/585.12 |
| 5,020,194 | A * | 6/1991 | Herrington et al. | 24/400 |
| 5,070,583 | A * | 12/1991 | Herrington | 24/400 |
| 5,161,286 | A * | 11/1992 | Herrington et al. | 24/400 |
| 5,638,586 | A | 6/1997 | Malin | |
| 5,664,299 | A * | 9/1997 | Porchia et al. | 24/400 |
| 5,871,281 | A * | 2/1999 | Stolmeier et al. | 383/64 |
| 6,385,818 | B1 * | 5/2002 | Savicki, Sr. | 24/30.5 R |
| 6,517,242 | B1 * | 2/2003 | Buchman | 383/64 |
| 6,761,481 | B1 | 7/2004 | Bois | |
| 7,213,303 | B1 * | 5/2007 | Savicki | 24/30.5 R |
| 7,416,340 | B2 * | 8/2008 | Schneider | 383/64 |
| 7,690,090 | B2 | 4/2010 | Swain et al. | |
| 2004/0086206 | A1 | 5/2004 | Tomic | |

FOREIGN PATENT DOCUMENTS

| | | |
|---|---|---|
| CN | 2292428 | 9/1998 |
| EP | 0479661 | 4/1992 |
| JP | 4128133 | 7/2008 |
| WO | 2008060752 | 5/2008 |

* cited by examiner

*Primary Examiner* — Robert J Sandy
(74) *Attorney, Agent, or Firm* — McCarter & English, LLP

(57) ABSTRACT

The water-resistant zipper includes first and second profiles which are interlocked or separated by the movement of a slider. A triangular island and separating plow are formed at the opening end to separate the first and second profiles. The slider includes various channels which engage corresponding rails in the profiles in order to properly position the profiles.

12 Claims, 4 Drawing Sheets

SLIDER FOR WATER-RESISTANT ZIPPERS

This application is a continuation-in-part of application Ser. No. 11/820,544 filed on Jun. 20, 2007, to issue as U.S. Pat. No. 7,849,565, which is hereby incorporated by reference in its entirety.

BACKGROUND OF THE DISCLOSURE

1. Field of the Disclosure

The present invention relates to a slider for a water-resistant reclosable zipper. In particular, the design of this slider allows both easy opening and closing of the zipper while maintaining the water-resistant characteristics.

2. Description of the Prior Art

Examples of water-resistant reclosable zippers are shown in FIGS. 1A, 1B, 1C, 1D and 1E. These zippers, or similar zippers, may be used with sliders such as are disclosed in U.S. Pat. No. 7,690,090 entitled "One-Sided Rail Slider for Reclosable Zipper", issued on Apr. 6, 2010. While these zippers and sliders are well-developed and have proven satisfactory for their intended purposes, further improvements are sought in providing increased ease in the opening and closing of the zipper while maintaining the water-resistant configuration and further providing a place for the slider to park when not in use.

OBJECTS AND SUMMARY OF THE DISCLOSURE

It is therefore an object of the present disclosure to provide a water-resistant slider zipper with increased ease in opening and closing, as well as finding a place to park the slider when not in use, while maintaining the water-resistant configuration.

These and other objects are attained by providing a water-resistant zipper with a slider which straddles the zipper profiles in its vertical position thereby engaging both zipper profiles simultaneously. The slider includes a separating plow that protrudes between the two profiles in order to effect the opening of the zipper profiles. A portion of one of the zipper profiles is excised in order to accommodate the separating plow when the slider is in the parked position. Therefore, when the profile is closed, the water-resistant seal remains engaged. As the user pulls the slider along the top of the zipper, the separating plow separates the interlocked profiles. Likewise, when the slider is pulled in the opposite direction, the inner dimension of the slider squeezes the profiles into an interlocked configuration. Further, the zipper is typically provided with an end cap on one end and a slider parking station on the other end. The end cap and the slider parking station typically have undercut inclined walls to engage the inclined walls of the slider.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1A:
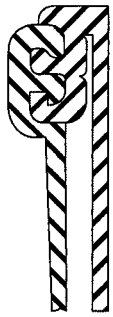
FIGS. 1A, 1B, 1C, 1D and 1E are cross-sectional views of various prior art water-resistant zippers.
Figure 1B:
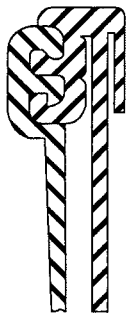
Figure 1C:
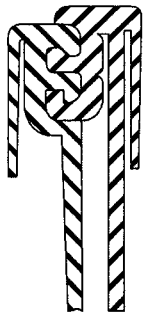
Figure 1D:
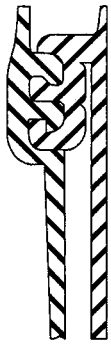
Figure 1E:
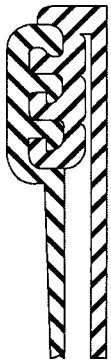
Figure 2:
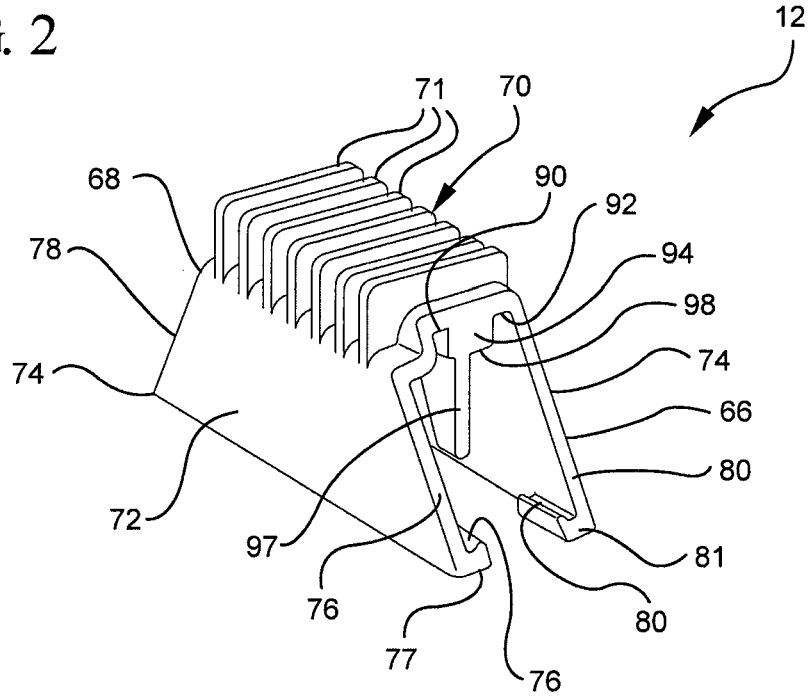
FIG. 2 is a top perspective view of the slider of the zipper assembly of an embodiment of the present disclosure.
Figure 3:
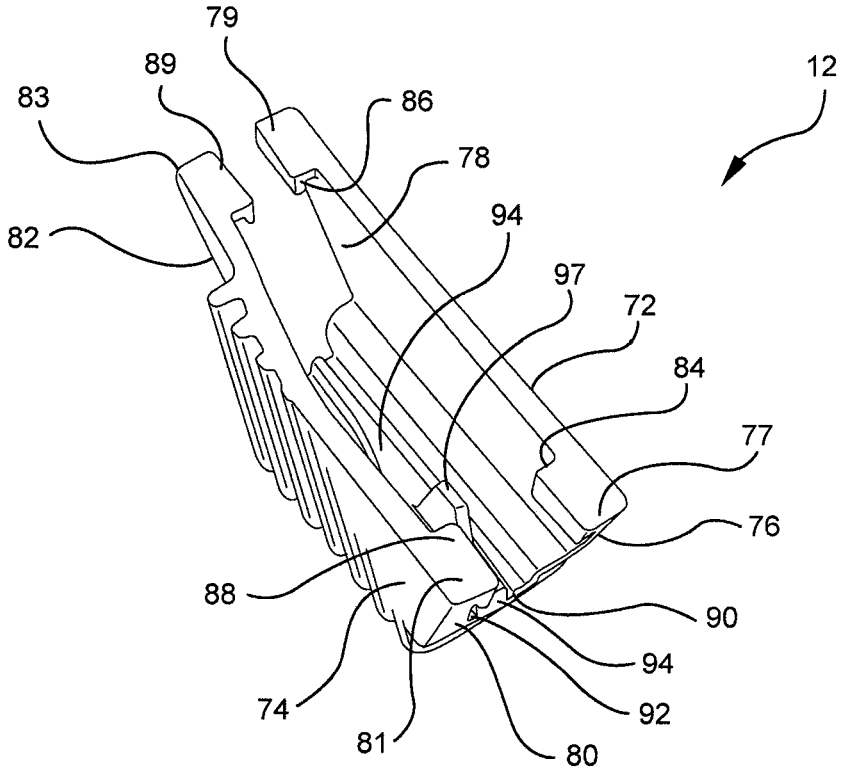
FIG. 3 is a first bottom perspective view of the slider of the zipper assembly of an embodiment of the present disclosure.
Figure 4:
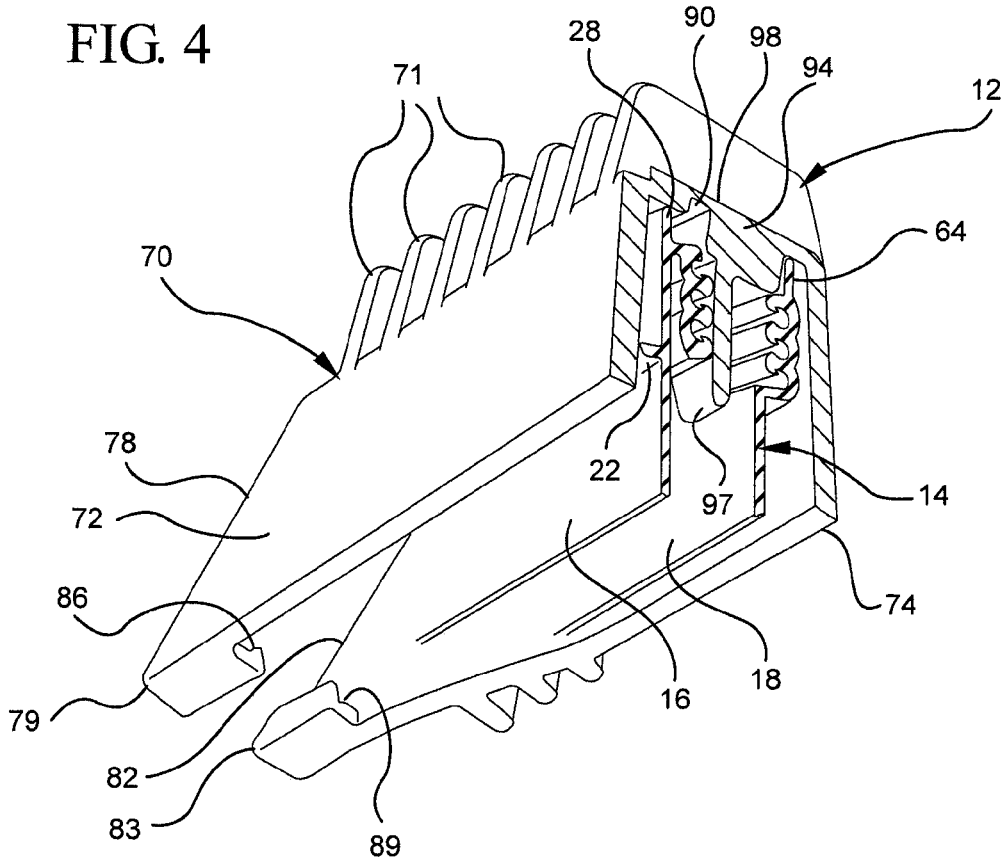
FIG. 4 is a second bottom perspective, partially, cut-away, view of the slider of the zipper assembly of an embodiment of the present disclosure.
Figure 5:
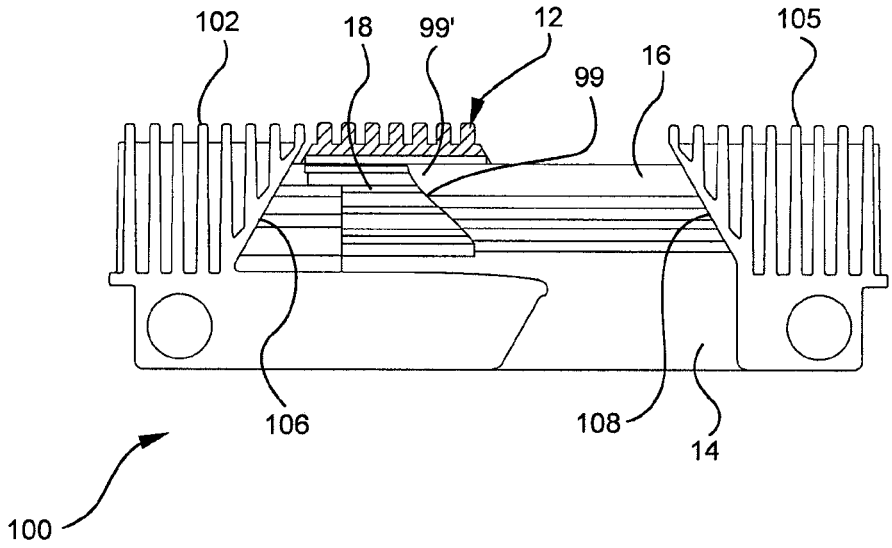
FIG. 5 is a perspective, partially cut-away, view of the zipper assembly of an embodiment of the present disclosure.
Figure 6:
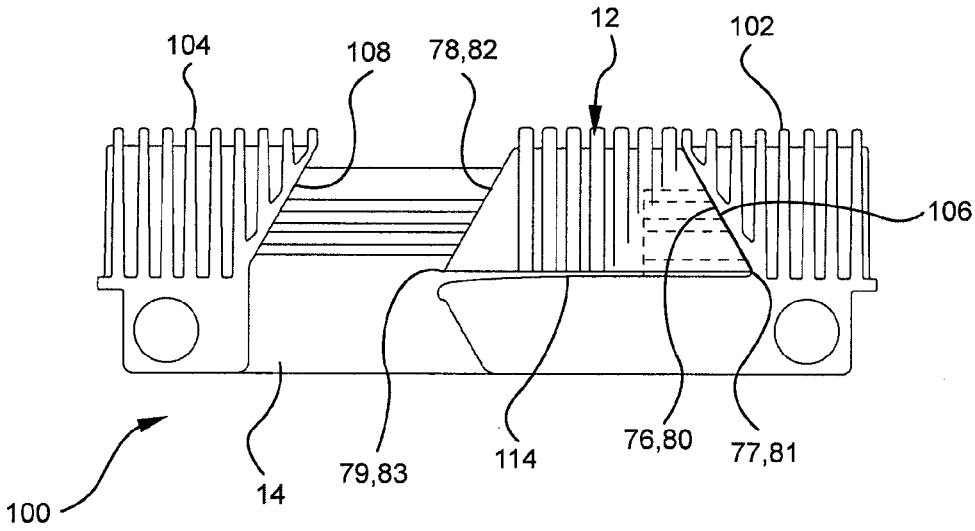
FIG. 6 is a plan view of a zipper assembly using an embodiment of the slider of the present disclosure.

Referring now to the drawings in detail wherein like numerals indicate like elements throughout the several views, one sees that FIGS. 2-4 are perspective views of slider 12 while FIGS. 5 and 6 are perspective views of the slider 12 engaging zipper 14 so as to form zipper assembly 10. FIGS. 4 and 5 are partially cut-away.

Figure 4A:
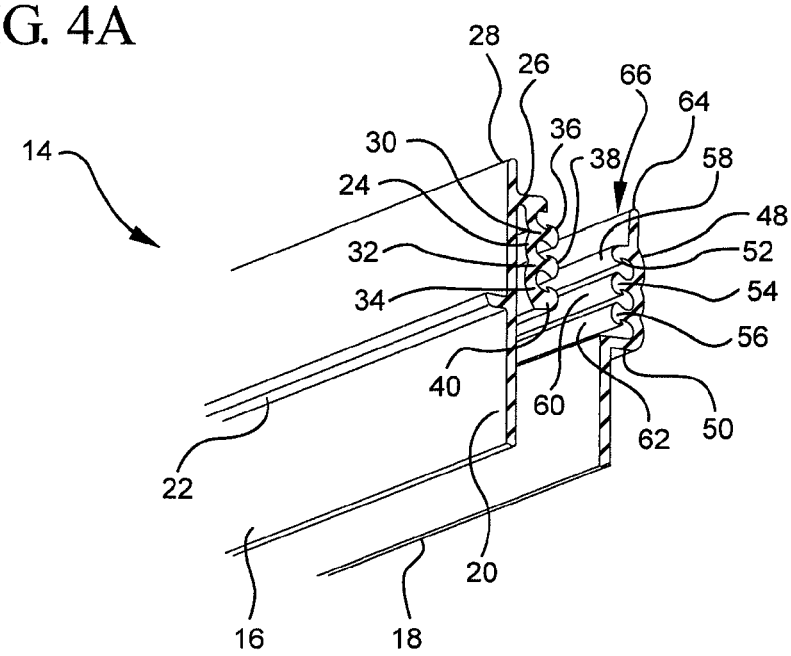
FIG. 4A is a perspective view of the zipper of FIG. 4.

As shown in FIGS. 4 and 4A, zipper 14 includes first profile 16 and second profile 18. First profile 16 includes first flange 20 which further includes rail 22. First flange 20 extends across the outward face of first interlocking element 24 and is hinged to the top of first interlocking element 24 at hinged point 26. Additionally, first upper rail 28 extends upwardly from hinged point 26. First interlocking element 24 includes inwardly extending teeth 30, 32, 34 terminating in respective detent heads 36, 38, 40.

Second profile 18 includes second flange 46 which is inwardly offset from second interlocking element 48 by horizontal inverted ledge 50. First and second flanges 20, 46, are used to attach the zipper 14 to the walls of a container, package or pouch (not shown). Second interlocking element 48 includes inwardly extending teeth 52, 54, 56 terminating in respective detent heads 58, 60, 62. Inwardly extending teeth 30, 32, 34 interlock with respective interlocking teeth 58, 60, 62 in the interlocked configuration. Further, the offset provided by horizontal inverted ledge 50 allows first and second flanges 20, 46 to be positioned immediately adjacent to each other when the first and second profiles 16, 18 are in the interlocked configuration. Second profile 18 further includes second upper rail 64 extending upwardly from the upper portion of second interlocking element 48.

As shown in FIGS. 2-4, slider 12 includes opening end 66 wherein first and second profiles 16, 18 are separated and closing end 68 wherein first and second profiles 16, 18 are interlocked. It should be noted that a portion of the opening end 66 is cut-away from FIG. 4 in order to show the internal structure of slider 12. Slider 12 includes top wall 70 (including upwardly extending gripping extensions 71) from which first sidewall 72 and second sidewall 74 descend. First sidewall 72 includes opening end first inclined wall 76 (terminating in opening end first tip 77) and closing end first inclined wall 78 (terminating in closing end first tip 79).

Similarly, second sidewall 44 includes opening end second inclined wall 80 (terminating in opening end second tip 81) and closing end second inclined wall 82 (terminating in closing end second tip 83). Tips 77, 79 include respective inwardly extending ledges 84, 86 for engaging the rail 22 of first flange 20 of first profile 16 of zipper 14. Likewise, tips 81, 83 include respective inwardly extending ledges 88, 89 for engaging inverted horizontal ledge 50 of second profile 18.

First and second channels 90, 92 are formed in the underside of top wall 70 to be engaged by respective first and second upper rails 28, 64. At opening end 66 of slider 12, first and second channels 90, 92 are separated by generally triangular island 94. First and second channels 90, 92 form a close parallel relationship (or form a unified channel) to the rear of triangular island 94.

Separating plow 97 extends downwardly from forward end 98 of triangular island 94 proximate to opening end 66. Separating plow 97 serves to fully separate interlocking teeth 30, 32, 34 of first interlocking element 24 from interlocking teeth 52, 54, 56 of second interlocking element 48 and to maintain first and second profiles 16, 18 against the interior of respective first and second sidewalls 72, 74.

FIGS. 5 and 6 disclose a plan view of an embodiment of a zipper assembly 100 which includes slider 12 and zipper 14 as described above, along with slider parking station 102 and end cap 104 formed at opposite ends of zipper 14. The ends of first and second zipper profiles 16, 18 are welded together. Slider parking station 102 and end cap 104 include respective first and second undercut inclined walls 106, 108 for receiving or accommodating the respective opening end inclined walls 76, 80 and the closing end inclined walls 78, 82. The undercut characteristic of the first and second undercut inclined walls 106, 108 makes the first and second undercut inclined walls 106, 108 closer to each other at an upper section thereof (proximate to the top of the zipper 14), than they are at a lower section thereof. The complementary structure of the opening end inclined walls 76, 80 and closing end inclined walls 78, 82 with respect to the first and second undercut inclined walls 106, 108 assures that the separating plow 97 is securely forced between the first and second profiles 16, 18 of zipper 14. Additionally, lower horizontal wall 114 (the "horizontal" direction being that of the longitudinal axis of the zipper 14) of slider parking station 102 assures the vertical placement of slider 12 in the parked position, limiting the downward movement of slider 12 as opening end inclined walls 76, 80 are urged against first undercut inclined wall 106 when slider 12 is being parked in a position which closes the zipper 14.

Typically, the zipper 14, the slider parking station 102 and the end cap 104 are welded or similarly attached to the walls of a bag, pouch or similar structure (not shown) in order to maintain the water-resistance characteristic of the structure. Additionally, as shown in FIG. 5, a portion of first profile 16 adjacent to slider parking station 102 is removed or excised along diagonal line 99 (thereby allowing a portion of the interior second profile 18 to be visible) thereby resulting in tip 99' and allowing the slider 12 to park in the position shown in FIG. 5 with the first and second zipper profiles 16, 18 fully interlocked and not pushed apart by separating plow 97 (not shown in FIG. 5) thereby maintaining the water-resistant configuration. Additionally, when the user moves the slider 12 in the opening direction (starting at the furthest left hand position and then moving toward the right in the orientation shown in FIG. 5), the tip 99' on first zipper profile 16 is engaged by the separating plow 97 (see FIGS. 2 and 3) thereby separating or peeling apart the first and second zipper profiles 16, 18.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper assembly including:

a zipper including first and second interlocking profiles, the zipper further including a first end and a second end;

a slider mounted on the zipper, the slider moving in a first direction separating the first and second interlocking profiles, the slider moving in a second direction interlocking the first and second interlocking profiles;

a slider parking station attached to the first end of the zipper, the slider parking station including a first inclined wall for receiving the slider, wherein a portion of the first interlocking profile is removed adjacent to the slider parking station;

an end cap attached to the second end of the zipper, the end cap including a second inclined wall for receiving the slider;

the slider including:

a top wall;

a first sidewall extending from a first side of the top wall;

a second sidewall extending from a second side of the top wall;

an opening end wherein the first and second sidewalls are relatively further apart and a closing end wherein the first and second sidewalls are relatively closer together, the opening end including a third inclined wall which is complementary to the first inclined wall, and the closing end including a fourth inclined wall which is complementary to the second inclined wall, wherein the third and fourth inclined walls are undercut;

the top wall including first and second upper channels separated from each other at the opening end by a triangular island, further including a separating plow descending from the triangular island, wherein the first and second channels are relatively further apart at the opening end and relatively closer together at the closing end; and wherein the first and second inclined walls are configured and arranged so that the first and second inclined walls are closer together at the top wall of the slider than at a lower edge of the slider.

2. The zipper assembly of claim 1 wherein the portion of the first interlocking profile is removed along a diagonal line thereby forming a tip on the first interlocking profile.

3. The zipper assembly of claim 2 wherein the separating plow engages the tip thereby peeling the first interlocking profile from the second interlocking profile when the slider is moved away from the slider parking station.

4. The zipper assembly of claim 3 wherein the island includes one face adjacent to the opening end and one point directed toward the closing end.

5. The zipper assembly of claim 4 wherein the first upper channel passes along a first side of the island and the second upper channel passes along a second side of the island.

6. The zipper assembly of claim 5 wherein the first and second upper channels form a parallel relation toward the closing end of the slider.

7. A zipper including:

a first interlocking profile including a first upper rail and a second interlocking profile including a second upper rail;

a slider mounted on the zipper, the slider moving in a first direction separating the first and second interlocking profiles, the slider moving in a second direction interlocking the first and second interlocking profiles;

a slider parking station attached to the first end of the zipper, the slider parking station including a first inclined wall for receiving the slider, wherein a portion of the first interlocking profile is removed adjacent to the slider parking station;

an end cap attached to the second end of the zipper, the end cap including a second inclined wall for receiving the slider;

the slider including a top wall, a first sidewall extending from a first side of the top wall, a second sidewall extending from a second side of the top wall, an opening end wherein the first and second sidewalls are relatively further apart and a closing end wherein the first and second sidewall are relatively closer together; wherein the top wall includes first and second upper channels for engagement by the respective first and second upper rails, the first and second upper channels separated from each other at the opening end by a triangular island, further including a separating plow descending from the triangular island; and wherein the first and second channels are relatively further apart at the opening end and relatively closer together at the closing end;

the opening end of the slider including a third inclined wall which is complementary to the first inclined wall, and the closing end of the slider including a fourth inclined wall which is complementary to the second inclined wall, wherein the third and fourth inclined walls are undercut; and wherein the first and second inclined walls are configured and arranged so that the first and second inclined walls are closer together at the top wall of the slider than at a lower edge of the slider.

8. The zipper of claim 7 wherein the portion of the first interlocking profile is removed along a diagonal line thereby forming a tip on the first interlocking profile.

9. The zipper of claim 8 wherein the separator profile engages the tip thereby peeling the first interlocking profile from the second interlocking profile when the slider is moved away from the slider parking station.

10. The zipper of claim 9 wherein the island includes one face adjacent to the opening end and one point directed toward the closing end.

11. The zipper of claim 10 wherein the first upper channel passes along a first side of the island and the second upper channel passes along a second side of the island.

12. The zipper of claim 11 wherein the first and second upper channels form a parallel relation toward the closing end of the slider.

* * * * *